US010104995B2

(12) United States Patent
Kelaher et al.

(10) Patent No.: US 10,104,995 B2
(45) Date of Patent: Oct. 23, 2018

(54) CLOSEABLE BEVERAGE LID

(71) Applicant: Goverre, Inc., San Marcos, CA (US)

(72) Inventors: Regan Katherine Kelaher, Encinitas, CA (US); Shannon Mari Zappala, San Marcos, CA (US)

(73) Assignee: Goverre, Inc., San Marcos, CA (US)

( * ) Notice: Subject to any disclaimer, the term of this patent is extended or adjusted under 35 U.S.C. 154(b) by 0 days.

(21) Appl. No.: 15/836,693

(22) Filed: Dec. 8, 2017

(65) Prior Publication Data

US 2018/0098651 A1 Apr. 12, 2018

Related U.S. Application Data

(63) Continuation of application No. 14/592,907, filed on Jan. 9, 2015, now Pat. No. 9,883,759.

(Continued)

(51) Int. Cl.

| | |
|---|---|
| ***B65D 43/04*** | (2006.01) |
| ***B65D 53/02*** | (2006.01) |
| ***A47G 19/22*** | (2006.01) |

(52) U.S. Cl.

CPC ..... *A47G 19/2272* (2013.01)

(58) Field of Classification Search

CPC ..... A47G 19/2272; A47G 19/2255; B65D 43/022

(Continued)

(56) References Cited

U.S. PATENT DOCUMENTS

| | | | |
|---|---|---|---|
| 2,685,319 | A | 8/1954 | Swansko |
| 2,833,324 | A | 5/1958 | Burroughs |

(Continued)

FOREIGN PATENT DOCUMENTS

| | | | |
|---|---|---|---|
| CN | 203619251 | U | 6/2014 |
| GB | 2482294 | A | 1/2012 |
| JP | 5240313 | B2 | 7/2013 |

OTHER PUBLICATIONS

The Wine Traveller; http://store.theproductfarm.com/wine/traveler/?sort=bestselling; Author = Unknown; Accessed Apr. 7, 2015.

(Continued)

*Primary Examiner* — J. Gregory Pickett
*Assistant Examiner* — Niki M Eloshway
(74) *Attorney, Agent, or Firm* — Richard B. Murphy

(57) ABSTRACT

An improved closeable lid for a beverage container is described. The lid uses a base, a flanged gasket, a valve and a knob to allow a user to control the flow of liquid from the beverage container. The flanged gasket surrounds the base with radially extending flanges that conforms to the interior of the beverage container, creating a seal. The valve moves vertically to engage and disengage the seal created by mating the valve face to the valve seat. The vertical movement of the valve is modulated by the rotation of a knob that is connected to the valve that provides a threaded shaft. The user can consume liquid from the beverage container as a result one or more fluid apertures through the base allowing for the passage of fluids from the beverage container past the valve and through base to the user. When the knob is rotated to the closed position, the valve creates a seal preventing the flow of liquid through the fluid apertures of the base.

15 Claims, 17 Drawing Sheets

Related U.S. Application Data

(60) Provisional application No. 61/925,225, filed on Jan. 9, 2014.

(58) Field of Classification Search
USPC ..... 220/714, 303, 804, 801, 378, 803
See application file for complete search history.

(56) References Cited

U.S. PATENT DOCUMENTS 3,015,411 A 1/1962 Smith
3,331,521 A 7/1967 Paige
3,374,298 A 3/1968 Studen
3,415,673 A 12/1968 Clock
3,604,584 A 9/1971 Shank
3,698,586 A 10/1972 Terner
3,730,399 A 5/1973 Dibrell et al.
3,825,142 A 7/1974 Campagna
3,859,117 A 1/1975 Erchak et al.
3,900,122 A 8/1975 Dichter
4,067,949 A 1/1978 Karabedian
4,086,373 A 4/1978 Tobias et al.
4,098,439 A 7/1978 Blow, Jr. et al.
4,133,923 A 1/1979 Blunt
4,184,603 A 1/1980 Hamilton
5,150,816 A 9/1992 DeCastro
5,180,585 A 1/1993 Jacobsen et al.
5,249,703 A 10/1993 Karp
5,324,489 A 6/1994 Nichols et al.
5,474,738 A 12/1995 Nichols et al.
5,909,820 A 6/1999 Yeh
5,954,219 A 9/1999 Nichols et al.
5,976,562 A 11/1999 Krall et al.
6,145,687 A 10/2000 Nichols et al.
6,659,302 B2 12/2003 Lin
6,702,138 B1 3/2004 Bielecki et al.
6,763,964 B1 * 7/2004 Hurlbut ..... A47G 19/2272 220/254.2
7,111,153 B2 9/2006 Sheetz, II et al.
7,273,147 B2 9/2007 Willat et al.
7,306,777 B2 12/2007 Bringley
7,549,556 B2 * 6/2009 Miller ..... A47G 19/2272 137/853
D609,972 S 2/2010 Reeser et al.
7,681,754 B1 * 3/2010 Ross ..... A47G 19/2272 215/387
D618,065 S 6/2010 Joy et al.
7,806,289 B2 10/2010 McCandlish et al.
7,819,280 B2 10/2010 Perra
7,886,924 B2 2/2011 Willat et al.
7,976,863 B2 7/2011 Wilcox et al.
D648,599 S 11/2011 Watanabe et al.
8,256,642 B2 9/2012 McNamara
8,272,532 B2 9/2012 Michaelian et al.
8,286,827 B2 10/2012 Yacktman
8,348,078 B2 1/2013 Lane
8,574,660 B2 11/2013 Weaver et al.
8,579,133 B2 11/2013 Marcus et al.
D701,091 S 3/2014 Joy
8,708,184 B2 4/2014 Thurlow
8,734,874 B1 5/2014 Paolone
8,765,113 B2 7/2014 Lewandowskii et al.
8,807,340 B2 8/2014 Zimmer
9,027,774 B2 5/2015 Palmer
2003/0116572 A1 6/2003 Klock et al.
2003/0189055 A1 10/2003 Thinnes
2005/0092759 A1 5/2005 Willat et al.
2007/0095849 A1 5/2007 Kim
2009/0155335 A1 6/2009 O'Shaughnessey et al.
2010/0200602 A1 * 8/2010 Chan ..... A47G 19/2272 220/714
2010/0314274 A1 12/2010 Saunders et al.
2011/0100854 A1 * 5/2011 Chapin ..... B65D 17/165 206/459.5
2011/0132781 A1 6/2011 Willat et al.
2011/0174830 A1 * 7/2011 Liao ..... A47G 19/2272 220/713
2011/0198349 A1 * 8/2011 Lane ..... A47G 19/2272 220/203.04
2011/0278315 A1 * 11/2011 Bower ..... A47G 19/2261 220/703
2012/0241453 A1 * 9/2012 Palmer ..... B65D 47/043 220/254.3
2013/0221009 A1 8/2013 Zimmer
2013/0240547 A1 * 9/2013 Osinga ..... A47G 19/2272 220/714
2013/0334162 A1 12/2013 Howcroft et al.
2014/0299601 A1 * 10/2014 Schiavone ..... A47G 19/2205 220/288
2014/0305945 A1 10/2014 Chan et al.

OTHER PUBLICATIONS

2014 Eco—friendly Silicone lids for cup or wine glass; Alibaba.com; Item No. 266632; Author = Unknown; Accessed Oct. 21, 2014.

Custom Clear Pyrex Glass Pitcher with Silicon Screening Lid; Alibaba.com; Item No. 90565; ; Author = Unknown; Accessed Oct. 21, 2014.

High Borosilicate Glass with Silicone; Alibaba.com; Item No. 257173; ; Author = Unknown; Accessed Oct. 21, 2014.

Goverre—A Glass portable wine glass; URL: https://www.kickstarter.com/projects/1747683510/goverre/a/glass/portable/wine/glass; Date: Mar. 31, 2014; Author = Kelaher and Zappala.

Bev/2/Go 10oz Tumbler; URL: http://www.bigguylittleguy.com/products/bev2go/10/oz/tumbler; Author = Unknown;; Accessed Apr. 7, 2014.

Dot/and/Bot Sit and Stand Portable Wine Glass; URL: http://www.dotandbo.com/collections/weekender/picnic/in/the/park/18807/sit/and/stand/portable/wine/glass; Author = Unknown; Accessed Dec. 8, 2014.

* cited by examiner

CLOSEABLE BEVERAGE LID

CROSS-REFERENCE TO RELATED APPLICATION

The present application is a continuation of U.S. patent application Ser. No. 14/592,907 filed Jan. 9, 2015 and which claims the benefit of U.S. Provisional Patent Application Ser. No. 61/925,225 filed Jan. 9, 2014, the entire teachings of which are herein incorporated by reference.

FIELD OF THE INVENTION

The present disclosure relates generally to beverage containers. More specifically, the present disclosure relates to removable lids which may be opened and shut by the user and may be applied to beverage containers, such as wine glasses.

BACKGROUND OF THE INVENTION

Beverage containers and corresponding lids are well known. Beverage container lids are used to deter or prevent liquid from leaving the beverage container unintentionally. Sippy cup lids are widely used to train babies and toddlers to drink from beverage containers while avoiding spillage. Likewise, sippy cup lids are widely used by the elderly and the infirm not as much for training purposes, but to allow the user, who may have difficulty using a standard beverage container, to drink unassisted while not spilling on oneself or others. Sippy cups are usually designed with a spout around which a user may place their mouth. The existence of a physical spout permits a toddler or the infirm with both a visual and tactical cue by which the user may accurately and successfully use the sippy cup.

Wine glasses are also well known. Wine glasses typically have an upper portion comprising an egg-shaped rim and bowl, where the rim is narrower than the widest part of the bowl. The upper portion of a traditional wine glass is connected to the lower portion of the wine glass, which usually consists of a thin stem and a disk-shaped base. Wine glasses have traditionally used clear glass or crystal in conjunction with the egg shaped configuration to allow for examination of the wine's visual characteristics, as well as enhanced oxidation, and the simultaneous concentration of aromas through the narrower rim. The thin stem and disk-shaped base allow a user to grip the glass by the stem and avoid transferring body heat affecting the temperature of the wine. Stemless wine glasses, those having the traditional truncated egg-shaped upper portion but without the stem, are also known in the art.

One disadvantage of the traditional wine glass, however, is that the relatively large opening defined by the rim does not prevent spillage and is not adapted to user mobility. Another disadvantage of the traditional wine glass is that the raised stem creates a high center of gravity, and is easily toppled. The concern for spillage is significant with wine because many wines can permanently stain or discolor surfaces on which the wine is spilled. Accordingly, a need exists for a device that provides a user with the advantages of those of a traditional wine glass while preventing spillage.

SUMMARY OF THE INVENTION

The present invention provides a removable and closeable lid for beverage containers having a concave opening, such as wine glasses, through which a user may consume the beverage.

One aspect of the present teachings is to provide a removable lid adaptable to the rim of a beverage container having a concave opening, such as an egg shaped wine glass. Another aspect of the present apparatus in accordance with the present teachings is to provide an aperture in a removable beverage container lid through which a user may consume the beverage while simultaneously permitting oxidation to occur. Yet another feature of the presently described apparatus is to allow a user to adjust the opening of the aperture through which liquid and air flows, including closing the aperture entirely.

For purposes of clarification, the terms "horizontal" and "vertical" when used herein are in reference to the orientation of the lid and/or lid components of the lid when fitted to a beverage container, said beverage container providing round horizontal rim substantially parallel to a surface on which it is placed. Consequently, the uses of the terms "upper" and "lower" refer to orientations on the vertical axis.

The term "closeable" as used herein is used in its conventional sense to indicate that the lid provides a mechanism to modulate fluid flow through the lid.

In one embodiment, a beverage lid comprises a base, a gasket, a valve, and knob. In an embodiment, the base provides a circular disk-shaped surface that is circumscribed by a peripheral flanged gasket. In an embodiment, the base creates a lip, adapted to rest on and mate to the rim of the beverage container. In one embodiment, the base has one or more apertures through which liquid can flow. In one embodiment, the base contains an additional aperture at its center, through which a knob is connected by a shaft to a valve below the base. In another embodiment, the base provides a threaded recess which engages the threaded stem of a valve, the knob being provided on the side of the reverse side of the valve.

In one embodiment, the valve is a disk-shaped surface parallel to the base. In one embodiment, the shaft of the knob and the aperture through which the shaft passes are threaded to translate the rotational activity of the knob into linear movement of the valve. In one embodiment, when the knob is rotated by the user, the disk-shaped surface of the valve moves linearly to interface with the gasket, creating a substantially fluid tight seal.

In one embodiment, the base has a disk-shaped surface recessed by a conical wall that extends upwardly. In one embodiment, a conical extension of the base creates a lip that is shaped to fit over the rim of a beverage container having a concave opening, such as a wine glass. In one embodiment, the base is surrounded by a flanged gasket, where said flanged gasket has one or more flanges that extend horizontally from the base. In one embodiment, the flange(s) is/are chamfered upwardly away from the base to contact the interior surface of the upper concave portion of a beverage container having a concave opening, such as a wine glass. In one embodiment, the chamfered flange(s) is/are made of flexible material which deflects upon application to the beverage container, but when inserted into the beverage container exert pressure on the diverging inner walls of the of the beverage container, creating a fluid tight pressure seal.

In one embodiment, where a threaded mechanism of valve actuation is employed, rotation the knob in one direction lifts the disk-shaped valve head upward to seal the bottom of the lid base, while rotating the knob in the opposite direction moves the valve head away from the base, permitting liquid and air to pass through the fluid aperture(s). In another embodiment, the valve is provided with a threaded stem that when the valve is rotated in a first direction the valve translates downward to contact the upper side of a gasket provided on the disc-shaped upper surface of the base providing a fluid tight seal and when the valve is rotated in the opposite direction the valve is lifted away from the gasket provided on the upper surface of the disc shaped surface of the base permitting liquid and air to pass through the fluid aperture(s).

In one embodiment, the conical wall and recessed base serve to create an overflow reservoir. In one embodiment, the upper opening(s) of the fluid aperture(s) in the recessed disk-shaped surface of the base, the fluid apertures communicating with lumen of the beverage container. One aspect to the present teachings is that unconsumed excess liquid flowing through the aperture(s) will accumulate in the recessed base reservoir before spilling over the lip. The reservoir enables pouring or consumption of fluids from any angle. When returned to the vertical position, the unused/unconsumed fluid in the reservoir is permitted to drain back into the beverage container through the fluid apertures in the base structure.

In one embodiment, the fluid aperture is formed as an arc having a focus at the center of the upper surface of the base. One aspect of the present disclosure is to provide at least one arced aperture circumscribing a substantial portion of the perimeter of the base, so liquid and air may flow freely and a user is not limited to consuming the beverage from only one area of the lid. Another aspect of the arced fluid aperture lying in the recessed base is to eliminate the need for a dedicated spout. In one embodiment, the arced fluid aperture permits for the enhanced flow of air either when at rest or when a user is drinking from the lid. One aspect to of the fluid aperture is to allow for oxidation of the beverage in the container. Another aspect of the arced fluid aperture is to remedy liquid turbulence or glugging during the user's beverage consumption.

DETAILED DESCRIPTION OF THE INVENTION

Figure 1:
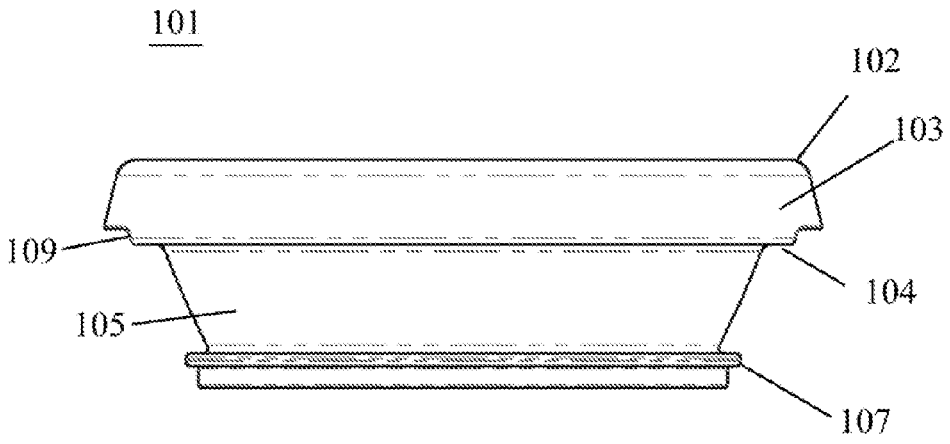
FIG. 1 is a two-dimensional profile view of an exemplary base to the closeable beverage lid made in accordance with the present teachings.
Figure 2:
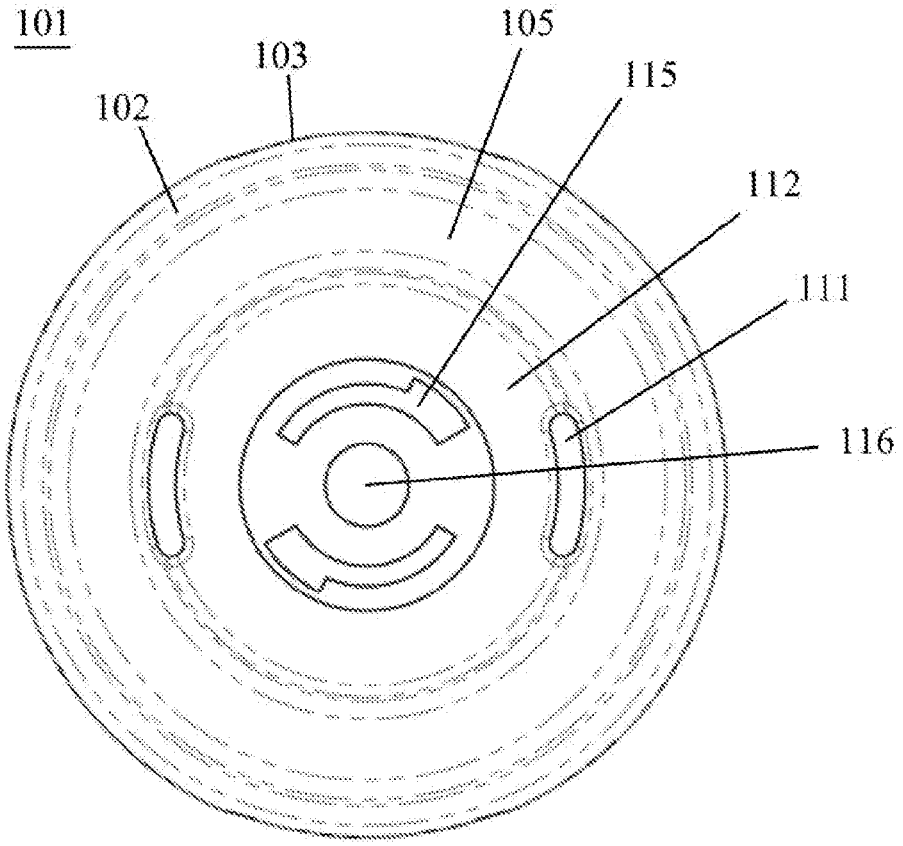
FIG. 2 is a two-dimensional top view of an exemplary base to the closeable beverage lid made in accordance with the present teachings.

Detailed embodiments of the present invention are disclosed herein. However, it is to be understood that the disclosed embodiments are merely illustrative of the invention that may be embodied in various forms. In addition, each of the examples given in connection with the various embodiments of the invention are intended to be illustrative, and not restrictive. Where a range of values is provided, it is understood that the upper and lower limits of the range and intervening values between the upper and lower limits of that range, as well as any subordinate ranges, is encompassed within the invention. As used herein, the singular forms "a", "and", and "the" shall be construed as including the plural unless the context clearly dictates otherwise. It will be apparent to those of skill in the art that the embodiments of the invention described herein may comprise discrete components that may be combined with components of other embodiments without departing from the scope of the present invention. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention. Furthermore, any section headings are merely for convenience of the reader and not intended to provide a limitation on the scope of the disclosure with respect to any feature of utility of the present invention.

In one embodiment, the present invention provides a closeable lid adapted for use with a beverage container having a concave opening, said lid comprising a base, said base comprising at least one aperture and a valve system, said valve system comprising a valve and valve actuating means, said valve opened or closed in response to operation of said valve actuating means, and, a flanged gasket, said flanged gasket horizontally circumscribing said base and having at least one flange wherein the external diameter of said flange is greater than the diameter of the opening of said beverage container and exerts a radial force against the inside wall of said beverage container to provide a substantially fluid-tight pressure seal when fitted to said beverage container.

In one embodiment, the present invention provides a lid as described above wherein the valve comprises a disc shaped head and a threaded stem, wherein the upper surface of the base provides a threaded recess to receive the threaded stem of said valve such that rotation of said valve in response to said valve actuating means results vertical displacement of the valve relative said base from a first open position to a second closed position. In another embodiment, the present invention provides a lid as described above wherein the lid further comprises a sealing gasket, said sealing gasket being provided on the upper surface of said base. In another embodiment, the present invention provides a lid as described above wherein the lid further provides a lid as described above wherein the sealing gasket is removable. In another embodiment, the present invention provides a lid as described above wherein the flange of the flanged gasket exerts a radial force against the inside wall of said beverage container to provide a substantially fluid-tight pressure seal. In another embodiment, the present invention provides a lid as described above wherein the lid is maintained in stable association with the beverage container without external retention means.

In another embodiment, the present invention provides an assembly comprising a lid as described above wherein further comprising a beverage container having a concave opening. In another embodiment, the present invention provides an assembly as described above further wherein the beverage container is provided with an energy absorbing covering. In another embodiment, the present invention provides an assembly as described above further wherein the beverage container is provided with an energy absorbing covering is removable.

In another embodiment, the present invention provides a lid for a beverage container having a concave opening said lid comprising a flanged gasket, said flanged gasket having at least one flange wherein the external diameter of said flange is greater than the diameter of the opening of said beverage container and exerts a radial force against the inside wall of said beverage container to provide a substantially fluid-tight pressure seal when fitted to said beverage container.

The disclosed teachings provide an advantageous apparatus designed to allow for beverage consumption through a removable recloseable lid that simultaneously prevents spillage. The term "removable" refers to the property of the lid being reversibly associated with a beverage container. The term "reclosable" refers to a lid which provides a valve system which regulates the fluid flow through fluid apertures in the lid. The improved beverage lid described herein permits for enhanced beverage oxidation as compared to traditional closeable beverage lids. The improved beverage lid described herein also eliminates the need for a dedicated spout, or the requirement of drinking form only one area of the lid. The present lid also discloses a flanged gasket which allows for the lid to removably attach and form a seal with, a beverage container having a concave opening, such as a wine glass. The present invention further provides a system comprising a lid comprising a base with a valve and one or more fluid apertures, a flanged gasket which allows for the lid to removably attach and form a seal with, and beverage container. The present invention further provides an assembly comprising a lid comprising a base comprising a valve and one or more fluid apertures, a flanged gasket, a beverage container and a removable energy-absorbing covering.

A. Beverage Container:

The term "beverage container" as used herein is used generically to refer to any hollow container used to hold a liquid including but not limited to glasses (in particular stemmed or stemless wine glasses), bottles, beakers, goblets, cups, decanters, carafes, pitchers and tumblers. In one embodiment, the beverage container is wine glass having a substantially round rim.

Figure 17:
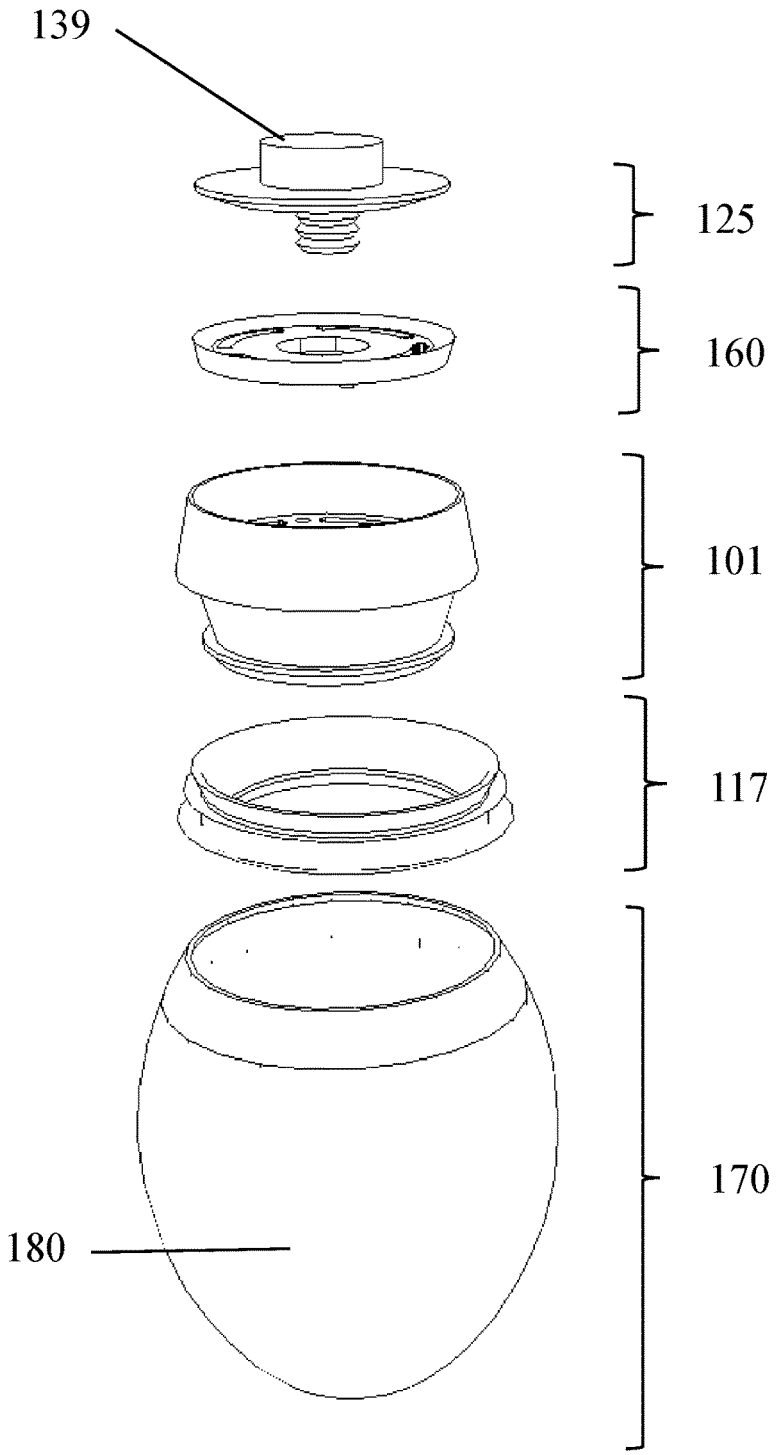
FIG. 17 is an exploded view of an assembly of a base, sealing gasket, valve, knob, beverage container and peripheral flanged gasket components of the closeable beverage lid illustrated in accordance with the present teachings.

The lid of the present invention is particularly adapted for use with beverage containers having a concave opening. As used herein, the term concave opening refers to a beverage container wherein the interior walls of the container diverge with respect to the opening of the beverage container for a distance below the plane defined by the rim of the beverage container. The portion of the beverage container wherein the walls diverge may be more than 3%, more than 5%, more than 7%, more than 10%, more than 20% or more than 30% of the vertical height of the container. An example of a beverage container having a concave opening is illustrated in FIG. 17 of the accompanying drawings.

The beverage container may be formed of any substantially rigid non-absorbent material conventionally used in the production of beverage containers including glass, plastic (e.g. polycarbonate, polystyrene), and metal (e.g. silver, stainless steel). The beverage container may be single walled or have a double walled to insulate the contents.

In one embodiment, the beverage container is formed of glass. Glass useful in the construction of the beverage container include conventional silicate glass such as soda-lime-silica glass, sodium borosilicate glass, or lead-oxide (crystal) glass. Additionally or optionally, the glass may be treated to enhance its durability ("toughened") through any of a variety of processes such including but not limited to heat—strengthening and tempering. Additionally or optionally, the glass contains additives to provide coloration (e.g. iron oxides, sulfur compounds, manganese, manganese dioxide, cobalt, chromium, cadmium, copper, gold, silver nitrate, copper oxide, titanium, and/or uranium) or light transmission properties (e.g. opacifiers such as tin oxide). Additionally or optionally, the glass is photochromic or photosensitive. In one embodiment of the invention, the beverage container is constructed of a toughed opaque translucent white silica glass.

The beverage container may also be provided with an energy absorbing covering to minimize the risk of breakage during use and/or transport and/or enhance grip by the user. Examples of energy absorbing coatings for glass articles, including those adapted for the provision of decorative features, are well known in the art. See, e.g. Swansko, U.S. Pat. No. 2,685,319 issued Aug. 3, 1954; Paige, U.S. Pat. No. 3,331,521 issued Jul. 18, 1967; Clock, U.S. Pat. No. 3,415,673 issued Dec. 10, 1968; Shank, U.S. Pat. No. 3,604,584 issued Sep. 14, 1971, Terner, U.S. Pat. No. 3,698,586, Oct. 17, 1972; McCoy U.S. Pat. No. 3,772,061 issued Nov. 13, 1973; Campagna U.S. Pat. No. 3,825,142 issued Jul. 23, 1974; Erchak and Campagna, U.S. Pat. No. 3,859,117 Jan. 7, 1975; Karabedian U.S. Pat. No. 4,067,949 issued Jan. 10, 1978; Tobias, and Taylor, U.S. Pat. No. 4,086,373 issued Apr. 25, 1978; Blunt, U.S. Pat. No. 4,133,923 issued Jan. 9, 1979, Marcus and Joy, U.S. Pat. No. 8,579,133 B2 issued Nov. 12, 2013, and Joy, United States Design Pat. No. D701,091 S issued Mar. 18, 2014. The energy absorbing covering may be continuous or provide one or more apertures. In one embodiment, the energy absorbing covering is formed as a mesh of energy absorbing material.

The energy absorbing covering may be constructed of any of a variety of deformable energy-absorbing materials including but not limited to one or more rubbers, silicone rubber, open or closed cell foams, neoprene, fabrics, fabric coated elastomeric materials, and the like.

B. Base:

The beverage lid of the present invention comprises a substantially rigid base structure which provides one or more fluid apertures and a valve system to modulate the flow of liquid through the vertical fluid passages.

The base provides a substantially rigid structure supporting the flanged gasket and valve system. The base is generally constructed of stiff materials, e.g., materials having a Young's Modulus of greater than about 0.5 GPa, preferably greater than 1.0 GPa. Also, because the base structure will come in contact with a variety of fluids, the materially is generally selected from non-absorbent materials. Examples of materials from which the base structure may be constructed include any of a variety of substantially rigid materials including but not limited to any of a variety of plastics such as polyethylene including high-density polyethylene (HPDE), polypropylene, polystyrene, acrylonitrile butadiene styrene (ABS), polycarbonate, ceramics, including ceramic alloys, metals, or combinations of the foregoing. The base may be constructed of a continuous material or may be produced with internal voids (e.g. foamed) to minimize material usage. The base may be produced from any of a variety of methods well known to those of skill in the art such as casting, molding, injection molding, or machining.

As it is anticipated that the materials of the lid including but not limited to the base, valve, flanged gasket, sealing gasket and any associated beverage container will be used in the provision of foodstuffs to human beings, the materials chosen should be chosen to minimize the leeching any toxic substances in to the fluids contemplated for use with the lid. In particular the materials used for construction of the lid are preferably free of, or do not leech substantial amounts, bisphenol A (BPA), bis(2-ethylhexyl) adipate, and phthalate esters. Guidelines and regulations for the minimization of leeching of such compounds are available from the United States Food and Drug Administration (FDA). In one embodiment of the invention, the materials used the lid are FDA approved for the use with foods.

The components of the lid, including each or all subassemblies and components, of the present invention may also be treated with one or more antimicrobial surface treatments to prevent adherence and/or growth of bacteria, viruses or fungi. Examples of such surface treatments are well known to those of skill in the art. Examples of commercially available antimicrobial surface treatments include those sold under the Microban® tradename by Microban International Ltd (Huntersville N.C., USA) and the SurfaceWise™ antimicrobial coating (Allied BioScience, Dallas Tex. US). Additional microbial surface treatments and additives include but are not limited to those described in Jacobsen, et al U.S. Pat. No. 5,180,585 A issued Jan. 19, 1993, Krall and Guggenbichler, U.S. Pat. No. 5,976,562 A issued Nov. 2, 1999, Lewandowski, et al U.S. Pat. No. 8,765,113 B2 issued Jul. 1, 2014, Bringley, et al., U.S. Pat. No. 7,306,777 B2 issued Dec. 11, 2007, Wilcox, et al. U.S. Pat. No. 7,976,863 B2 issued Jul. 12, 2011. O'Shaughnessy, et al US 2009/0155335 A1 published Jul. 18, 2009, Weaver, et al U.S. Pat. No. 8,574,660 B2 issued Nov. 5, 2013.

In one embodiment of the invention as illustrated in the attached figures, the invention provides a closeable beverage lid comprising a base (101), a flanged gasket (117), a disk-shaped valve (125) and a knob (139) is disclosed. Said base (101) further comprises a disk-shaped upper surface (112) surrounded by a conical wall (105) extending upward to form a lip (102) with a second wall (103) extending downwardly and a lower lip (104) which contacts the upper rim of the beverage container. The disk-shaped upper surface (112) of the base (101) further comprises at least one fluid aperture (111) through which liquid may flow.

The disk-shaped upper surface (112) of the base (101) also includes an aperture (116) through which the shaft (143) of the knob (139) can engage the threaded aperture (131) of the valve stem (129) and a positive stop feature (115) which limits the rotation of the knob (139) and by extension, limits the range of displacement by the valve (125).

FIG. 1 is a two-dimensional profile view of an exemplary base to the closeable beverage lid (101) made in accordance with the present teachings. As shown in FIG. 1, the base (101) comprises an inner conical wall (105) extending upwardly from the disk-shaped surface (not pictured) to form a lip (102) with an outer conical wall extending downwardly (103). In one embodiment (as shown in FIG. 1) the downwardly-extending conical wall (103) may include one or more cut-outs (109) along a portion of the lower edge of the outer wall (103) to permit a user's hands a finger-hold to grip and remove the lid (101) from a beverage container. The existence of one or more finger holds (109) allows a user to more easily remove the lid by providing a point of mechanical advantage to overcome the pressure seal exerted on the beverage container by the flanged gasket (117) shown in FIGS. 3-5. In an alternative embodiment, the downwardly-extending conical wall (103) may provide a plurality of ridges, protrusions, indentations that enhance the ability of the lid to be grasped by the user facilitating removal of the lid from the beverage container.

Figure 3:
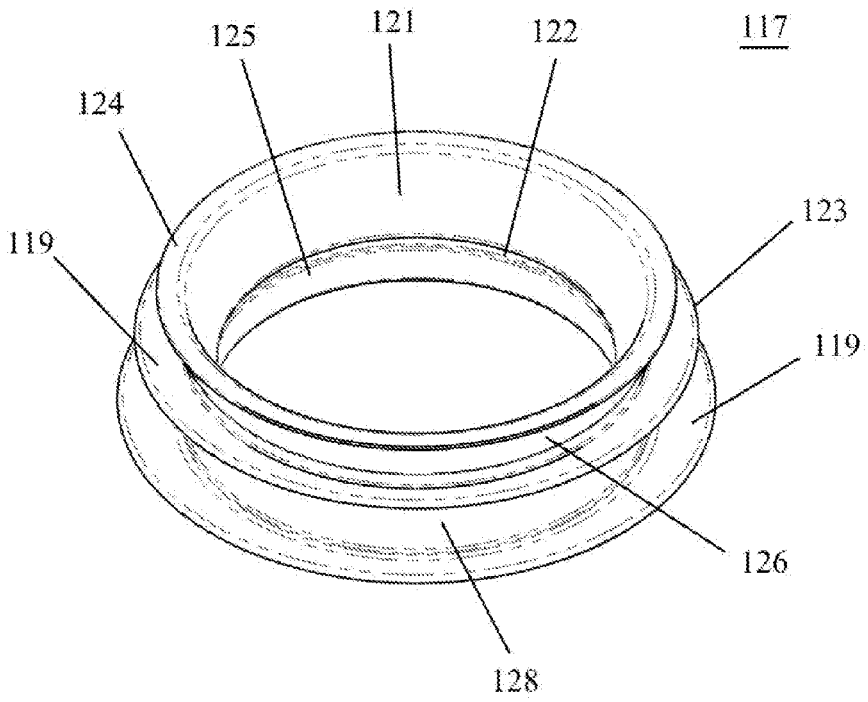
FIG. 3 is an isometric view showing the flanged gasket component of the closeable beverage lid illustrated in accordance with the present teachings.
Figure 4:
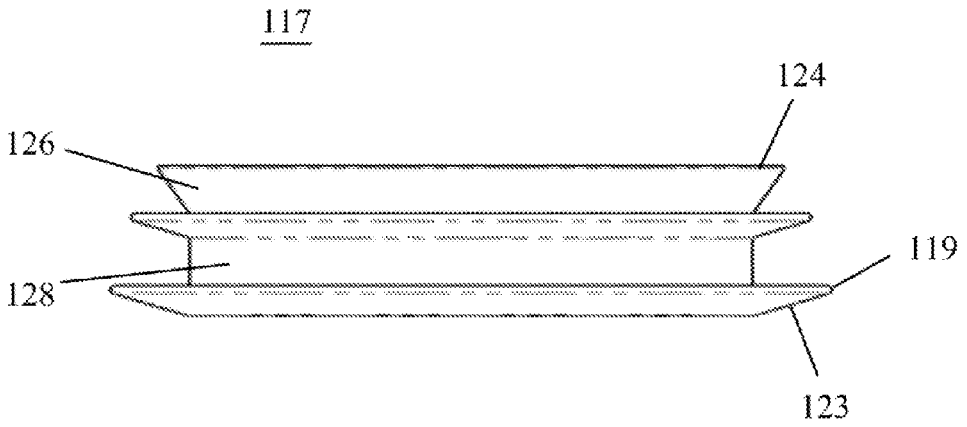
FIG. 4 is a two-dimensional profile view of the flanged gasket component of the closeable beverage lid illustrated in accordance with the present teachings.
Figure 5:
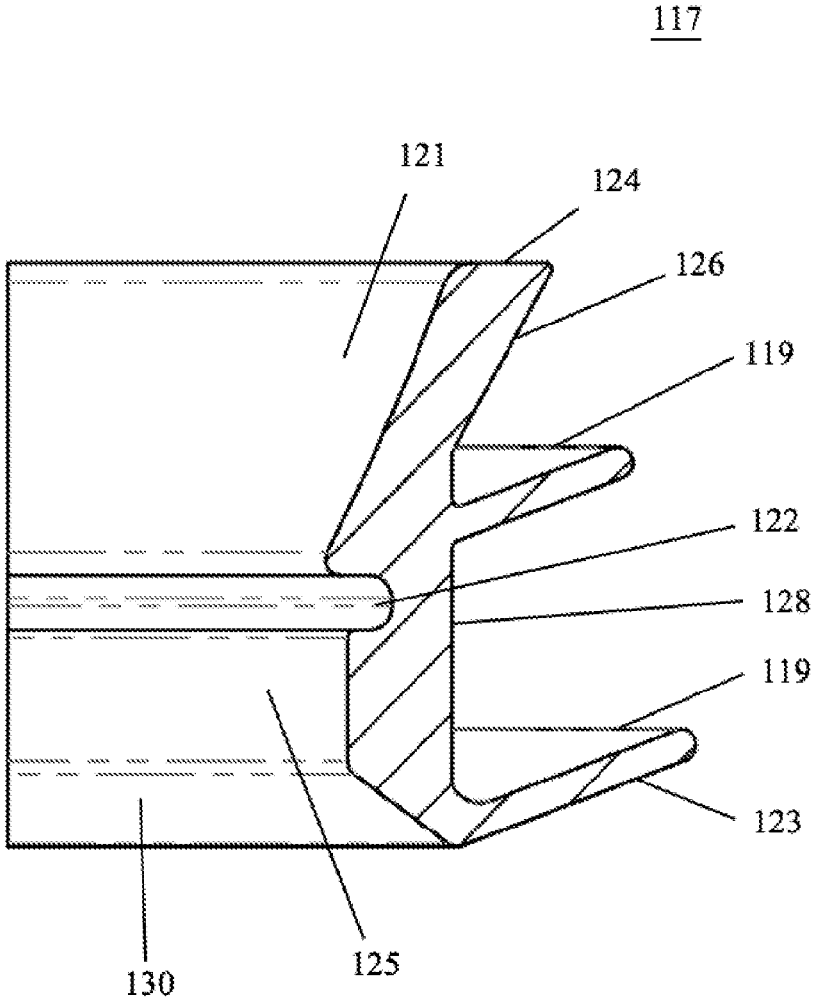
FIG. 5 is a vertical sectional view of the flanged gasket of the closeable beverage lid cut through the flanged portion of the gasket.

The outer surface of the base's inner wall (105) is oriented to interface with the inner surface of the flanged gasket (117) shown in FIGS. 3-5. In one embodiment of the invention as illustrated in FIG. 1, the base (101) provides an annular ridge (107) around the perimeter of the outer surface near the bottom of the base (101) and beneath the outer surface of the inner wall (105). The annular ridge (107) functions to mate with a corresponding groove (122) of the flanged gasket (117) to enhance the bonding of the flanged gasket (117) to the base (101) so that when force is applied to remove the lid from a beverage container (not pictured), the flanged gasket (117) remains secured to the base (101) and does not slip off. While the preferred embodiment of FIG. 1 discloses an inner conical wall (105) extending upwardly from the base with an expanding radius, those skilled in the art will appreciate that the conical wall (105) may be of static or dynamic radius, depending on the need for various applications.

Figure 13:
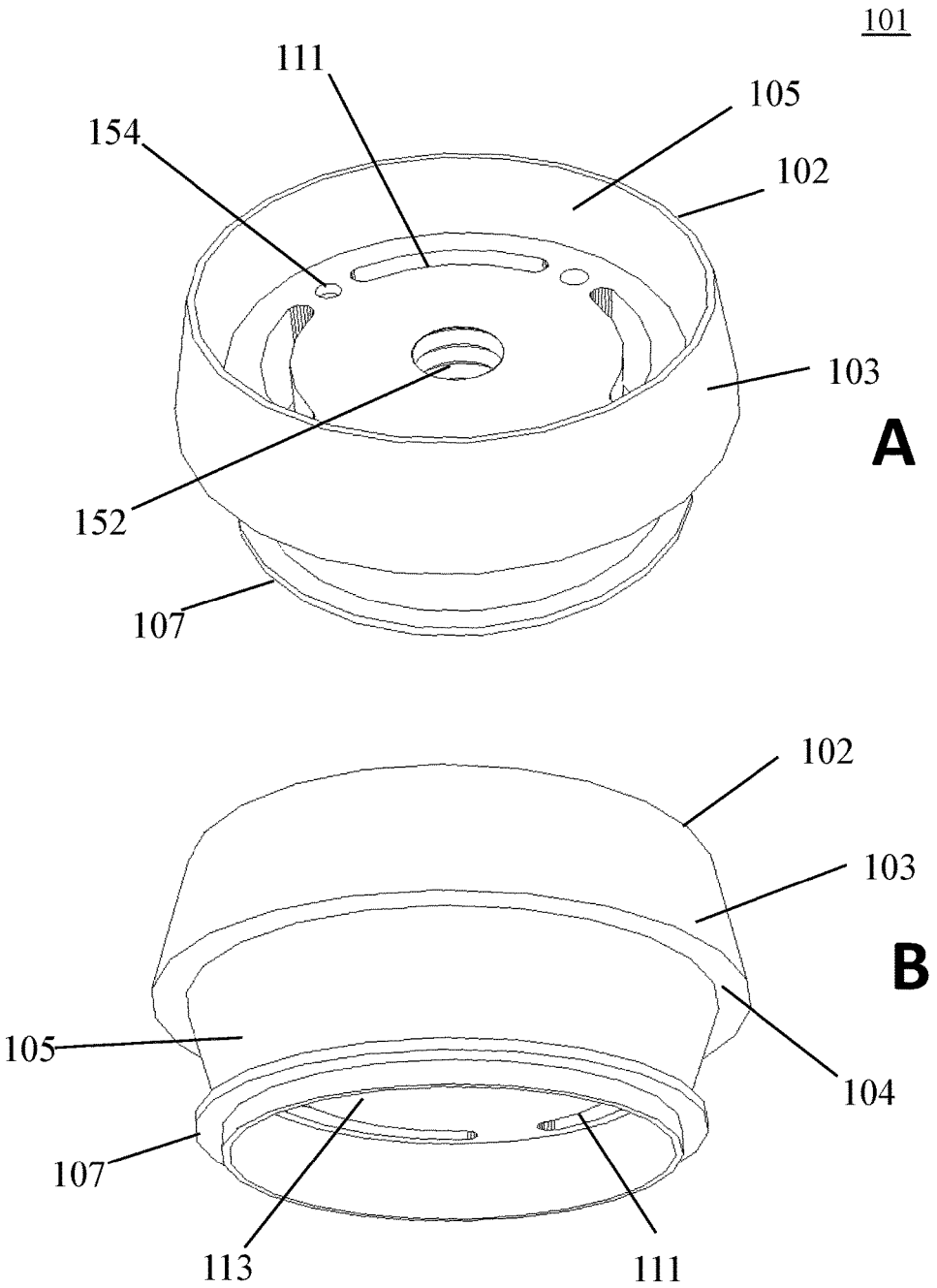
FIGS. 13 A and B are perspective views of a base component of the closeable beverage lid illustrated in accordance with the present teachings.

In an alternative embodiment of the invention as illustrated in the attached figures, the invention provides a closeable beverage lid comprising a base (101) said base (101) comprising disk-shaped upper surface (112) surrounded by a conical wall (105) extending upward to form a lip (102), a downwardly-extending wall (103) and a lower lip (104) surface that contacts the rim of the beverage container. The disk-shaped upper surface (112) of the base (101) further comprises at least one fluid aperture (111) through which liquid may flow. As illustrated in FIG. 13 A of the attached drawings, the disk-shaped upper surface (112) of the base (101) provides a threaded recess (152) that receives the threaded stem of a valve (not shown). Also illustrated in FIG. 13 are optional indexing recesses (154) that are designed to receive the indexing tabs of a sealing gasket (not shown).

FIG. 13 B provides an perspective view of the underside of a base (101) of the present invention illustrating the further illustrating disc-shaped lower surface (113) of the base (101), fluid aperture (111) through which flow may flow, the upper lip (102), a downwardly-extending wall (103) and a lower lip (104) that contacts the rim of the beverage container opening, the base's inner wall (105), and annular ridge (107).

Figure 14:
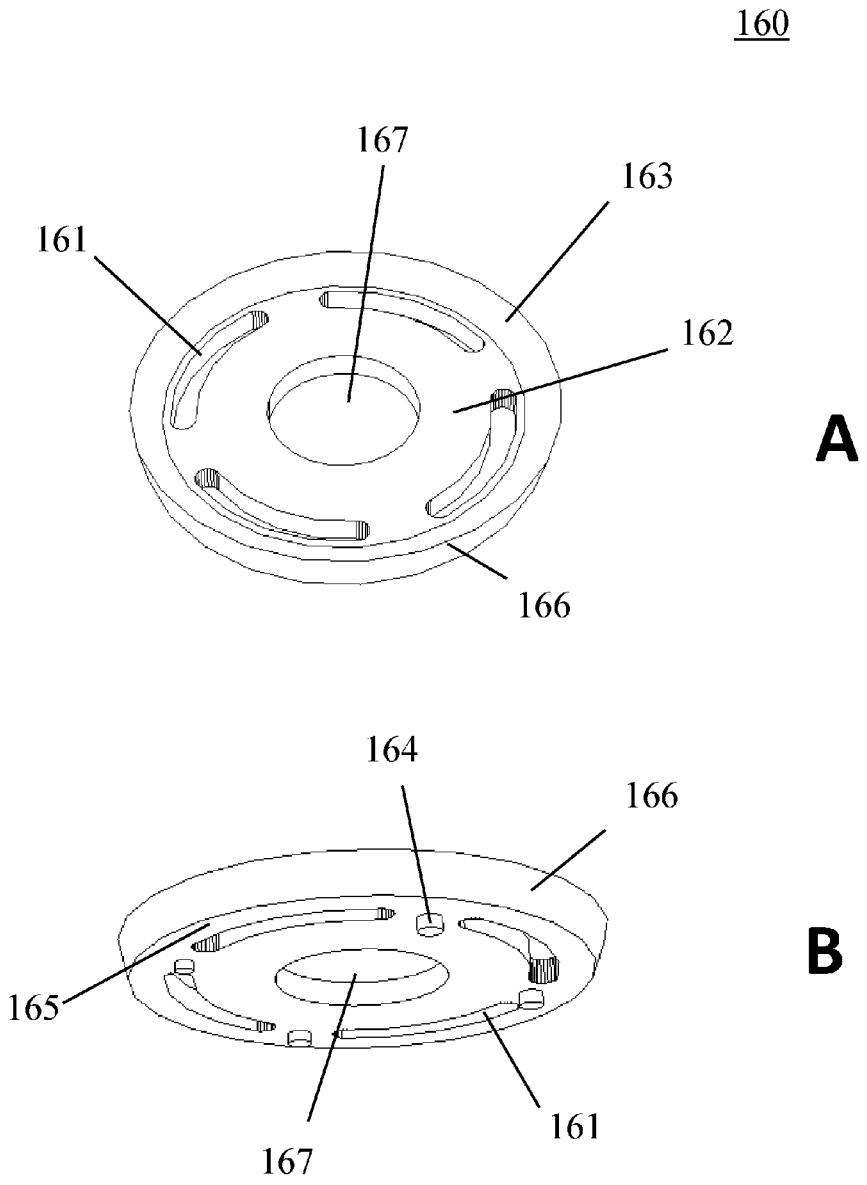
FIGS. 14 A and B are perspective views of a an upper surface of a sealing gasket (Panel A) and the lower surface of a sealing gasket (Panel B) components of the closeable beverage lid illustrated in accordance with the present teachings.

FIGS. 14 A and B provide upper (A) and lower (B) perspective views of a sealing gasket (160). In the illustrated embodiment, the sealing gasket provides apertures (161) that align with the fluid apertures (111) of the base (101) and provides a central aperture (167) to permit insertion of the threaded valve stem (not shown) into the threaded recess (152) provided in the upper surface of the base (112) and an peripheral (166). The under surface (165) of the sealing gasket (160) contacts the upper disk shaped surface (112) of the base (101) and provides apertures (161) that align with the fluid apertures (111) of the base (101).

FIG. 14 A illustrates features of the upper surface (162) of the sealing gasket including a beveled edge region (163) defining a valve seat and fluid apertures (161). FIG. 14 B illustrates features of the lower surface (162) of the sealing gasket apertures (161). The sealing gasket (160) may be permanently affixed to the upper surface (112) of the base (101). Permanent fixation of the sealing gasket (160) to the upper surface (112) of the base (101) may be achieved through any of a variety of bonding processes understood to those of skill in the art such as welding, adhesives, and the like. The peripheral wall (166) is generally provided to mate with the inner conical wall (105) of the base (101).

Alternatively, the sealing gasket may be removable from the base. When employing a removable sealing gasket, the correct placement of the sealing gasket (160) such that the fluid apertures of the sealing gasket (161) align with the fluid apertures of the base (111) is may be achieved through the use of one or more indexing tabs (164) (See FIG. 14, Panel B) which protrude from the lower surface of the sealing gasket which mate with the corresponding indexing recesses (154) provided in the upper surface (112) of the base (101).

C. Flanged Gasket

The lid provides a base structure in stable association with a peripheral flanged gasket, said gasket providing at least one deformable flange having a radius greater than the diameter of the opening of the beverage container. The flanged gasket may provide one, two, three, four, or more flanges. The deformable flange(s) of the flanged gasket is/are sufficiently deformable to permit insertion through and removal from the beverage container.

When the lid is associated with the beverage container, the flange(s) of the peripheral flanged gasket exert a radial force against the inside walls of the beverage container to provide a substantially fluid tight pressure seal and provide stable association between the lid and the beverage container.

In addition to providing a fluid-tight seal, the force exerted by the flange(s) of the flanged gasket exert sufficient force maintain the lid in stable association with the beverage container without the need for additional external fixation means and/or attachment structures incorporated into the beverage container that interact with the specific lid such as threads or specific configurations of the rim of the beverage container that specifically mate with a receiving structure in the lid. This enables the lid of the present invention to provide a fluid tight seal to a beverage container having a conventional opening and rim without requiring a beverage container having a rim specially designed for a particular lid.

As noted, the diameter of the deformable flange(s) of the flanged gasket is/are greater than the diameter of the opening of the beverage container. In one embodiment of the invention, the flange has an outer diameter of approximately 101% to approximately 130% of the diameter of the opening of the beverage container, alternatively from about 102% to about 120% of the diameter of the opening of the beverage container, alternatively from about 103% to about 110% of the diameter of the opening of the beverage container. Where multiple flanges are provided on the flanged gasket, each flange may be of the same outer diameter or of differing outer diameters. In order to accommodate the diverging diameter of the walls of a beverage container having a concave opening, the lower flange (i.e. that flange inserted furthest into the beverage container when the lid is associated with the beverage container) is of a diameter greater than flanges above it.

The flanged gasket may be formed of any of a variety of deformable materials to enable repeatable insertion and withdrawal from the beverage container with without damage to the flange(s). The term "deformable material" refers to a material having a Young's modulus of less than approximately 0.5 GPa, preferably less than about 0.2 GPa, less than about 0.1 GPa. Examples of materials useful in the construction of the gasket include any of a variety of elastomeric materials including but not limited to rubber, silicone, nitrile, closed cell foams, ethylene-propylene-diene-monomer (EPDM), or other thermoplastic elastomers. The design of the flanged gasket may further provide reinforcing elements to increase durability and/or radial force against the internal walls of the beverage container.

The gasket material may be coated or treated to provide additional sealing or handling properties.

The flanged gasket configured is to provide stable association with the base structure. Stable association between the gasket and base may be achieved through the use of adhesives, chemical bonding or various welding techniques well known to those of skill in the art such as ultrasonic welding, laser welding, solvent welding and the like. Alternatively, or in addition to, bonding of the flanged gasket to the base, stable association between the flanged gasket and the base may be achieved (or enhanced) through the use of one or more interlocking structures. An example of such an interlocking structure is through the use of one or more annular ridges protruding from the outer lower surface of the base and corresponding annular recesses in the inner surface of the flanged gasket.

FIG. 3 is an isometric view showing an exemplary embodiment of the flanged gasket (117) component of the closeable beverage lid illustrated in accordance with the present teachings. Said flanged gasket (117) comprises an upper part with an inner surface (121) and outer surface (126), a lower part with an inner surface (125) and an outer surface (128), and an annular notch (122) between the upper (121) and lower part (125) of the inner surface. The upper part (121) of the inner surface of the flanged gasket (117) is shaped to mate with the exterior of the inner wall (105) of the base (101). The upper part (121) of the inner surface of the gasket (117) further comprises an upper edge (124) which mates to the bottom of the lip (104) of the base (101) of the lid. The annular notch (122) of the inner surface of the flanged gasket (117) is shaped to mate with the annular ridge (107) on the outer surface of the base (101). The lower part (125) of the inner surface of the flanged gasket (117) is shaped to partially mate with the portion of the base (101) beneath the annular ridge (107), but it also shaped to extend below the base to partially mate with the chamfered valve face (135) of the valve (125).

The exemplary embodiment of the flanged gasket (117) disclosed in FIG. 3 further shows a plurality of flanges (119) extending horizontally from the outer surface of the gasket (117). The bottom of the outer-most portion of said flanges are chamfered (123) upwardly to provide enhanced flexibility to create a liquid-proof seal by mating with, and exerting pressure on the interior wall of a beverage container. While chamfered (123) flanges (119) are shown in the foregoing exemplary embodiment, those skilled in the art will understand that alternative options exist to allow for varied flexibility at a flange's extremity; such as decreasing thickness on both sides of the flanges, or the use of a support structure(s) molded in the base of a flange. Thus, while one embodiment of the flanged gasket (119) employs the use of a chamfered surface, alternative methods of varying a flange's flexibility are intended to be within the scope of this disclosure. Also, while two flanges (119) are shown, those skilled in the art will understand that the apparatus may include more or less, as long as the number, orientation, and placement of flanges exert sufficient tension on the interior of the beverage container to create a liquid-tight seal; and are thus intended to be within the scope of the present disclosure.

FIG. 4 is a two-dimensional profile view of the flanged gasket (117) component of the closeable beverage lid illustrated in accordance with the present teachings. Visible in this exemplary embodiment are the outer surface (126) of the upper portion of the gasket, the outer surface (128) of the lower portion of the gasket, as well as the gasket flanges (119) with chamfered bottom portions (123), and the upper edge (124).

FIG. 5 is a vertical sectional view of the flanged gasket (117) component of the closeable beverage lid. Visible in this exemplary embodiment are the upper part with an inner surface (121) and outer surface (126), a lower part with an inner surface (125) and an outer surface (128), an annular notch (122) between the upper (121) and lower parts (125) of the inner surface, and a chamfered edge (130) on the inner surface (125) of the lower part. Said chamfered edge (130) is shaped to mate with the chamfered valve face (135) of the valve (125) of FIGS. 6-9.

In an alternative embodiment of the invention wherein the valve seat is provided in the upper surface of the base or sealing gasket, the flanged gasket as described above may be employed, or alternatively, the flanged gasket can be simplified to eliminate the valve seat (130) formed in the lower portion of the flanged gasket (117) illustrated in FIG. 5 of the drawings.

D. Valve:

The valve is generally provided as a circular element which is moved from a first closed position to a second open position through valve actuating means. When the valve is closed, the valve substantially prevents fluid flow through the fluid apertures of the base. Conversely, when the valve is open, fluid flow is permitted through the fluid apertures of the base.

In one embodiment of the invention, the means for restricting fluid flow (valve) is a variation on a conventional poppet valve. The typical poppet valve (also referred to in the art as a tulip or mushroom valve) comprises a disk shaped head positioned at one end of a centrally located shaft (valve stem). The side of the valve head to which the valve stem is located provides a chamfered surface (termed the valve face) that provides a seal by being forced against a correspondingly shaped surface (termed the valve seat) in the base or flanged gasket.

The means for urging the valve face against the valve seat may be achieved by a variety of means including spring or mechanical actuation. In one embodiment, the poppet valve is moved from the open to the closed position by rotating the valve via a knob, the valve being provided with a threaded valve stem which interacts with corresponding threaded void in the base structure. Rotation of the knob causes the threaded valve assembly to rotate providing linear vertical movement of the valve relative to the base. When the valve is rotated, the valve moves linearly relative to the base structure from a first open position (wherein the valve face is not in contact with the valve seat) to a second position wherein the valve face is urged against the valve seat providing a fluid tight seal.

In another embodiment, the valve stem is provided with a threaded internal bore which engages a threaded shaft attached to a knob. The valve may provide an indexing protrusion (and corresponding groove in the base structure) that facilitates vertical motion of the valve head and restricts rotation in response to the rotational actuation of the knob.

The configuration of the valve seat angle is provided to facilitate fluid flow when in the open position and provide optimal sealing when in the closed position. Typically, the valve face and seat angles are between 10 and 80 degrees relative to the plane of the valve head, alternatively between 20 and 60 degrees, or alternatively between 30 and 50 degrees.

The shaft (valve stem) and valve head may be formed as a single component or be assembled from sub-assemblies. The valve may be solid or hollow.

In one embodiment, sealing may be provided by the valve seat being simply configured to mate with the valve face. Alternatively, sealing may be enhanced by the addition of elastic material to the valve face or valve seat. In one embodiment, the valve seat and/or valve face may be coated with a material such as rubber or silicone to enhance sealing. In another embodiment, the valve seat and/or valve face may be provided with a deformable elastic gasket (e.g. an O-ring gasket) to enhance sealing. In an alternative embodiment of the invention as exemplified herein, the valve seat may be formed by a chamfered surface in the lower portion of the peripheral seal. In another embodiment of the invention, the valve seat may be formed in a chamfered surface in the upper portion of a sealing gasket positioned on the upper disc shaped surface of the base.

Figure 6:
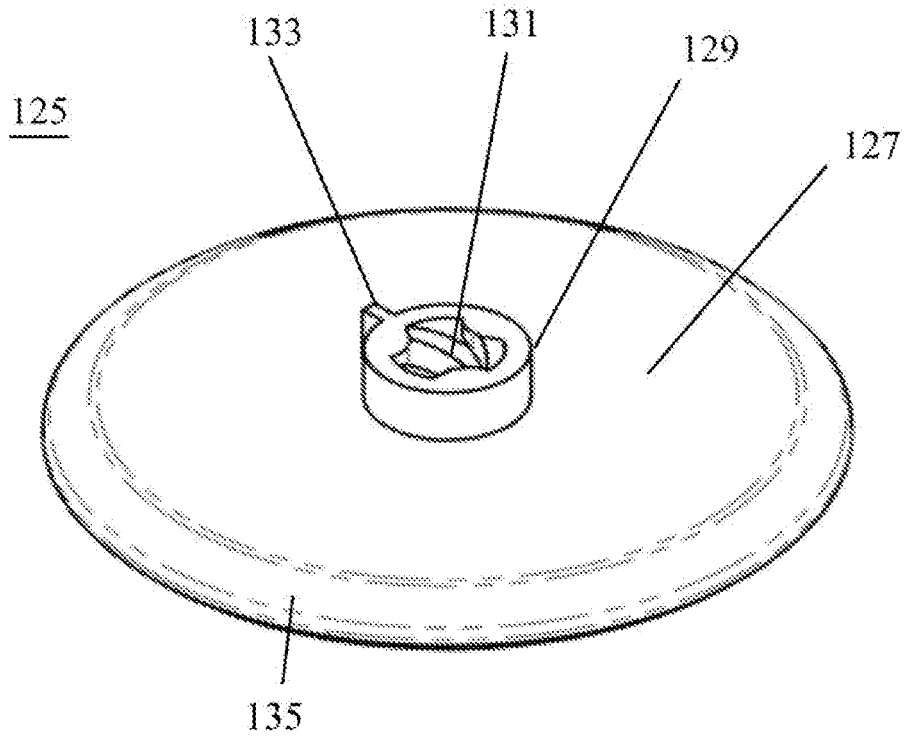
FIG. 6 is an isometric view of the disk-shaped plunger component of the closeable beverage lid illustrated in accordance with the present teachings.

FIG. 6 is an isometric view of an exemplary embodiment of the valve (125) component of the closeable beverage lid illustrated in accordance with the present teachings. The valve (125) comprises an upper surface (127) and a substantially flat reverse surface (137) (not visible), said upper surface having a chamfered edge defining the valve face (135).

The valve (125) further comprises a shaft (or stem) substantially perpendicular to the valve head (129). In the embodiment illustrated herein, the valve stem (129) is provided with a vertical indexing flange (133). Said vertical flange (133) limits rotation of the knob (139) and prevents over-torqueing of the valve (125) by interfacing with the bottom of the stop-feature (115) found in base (101) of the lid. Said valve stem (129) contains a fastening aperture (131) for receiving the shaft of the knob (not pictured). In this exemplary embodiment, the aperture (131) employs female threading as a mechanism for engaging the shaft of the knob, but one skilled in the art will appreciate that alternative mechanisms for fastening the knob shown in FIGS. 10-13 to the valve stem (129) are intended to be within the scope of this disclosure.

In one embodiment, the valve seat is defined by a chamfered portion of the flanged gasket. When the flanged gasket (117) is fitted to the base (101) and the valve head (125) is connected through the base (101) to the knob (139), the lid has two positions based on the rotation of the knob (139): "closed" and "open." When knob (139) is in the "open" position, the valve face (135) is displaced vertically away from the valve seat (130) formed in the flanged gasket (117) so liquid can pass beyond the valve face (135) and flow through the fluid apertures (111). However, when the knob is in the "closed" position of rotation, the valve face (135) is moved to be in contact with the valve seat (130) formed in the flanged gasket (117) such that the chamfered valve seat (135) of upper surface (127) of the valve (125) is mated to the chamfered valve seat (130) formed in the lower part (125) of the inner surface of the gasket (117) to create a liquid-proof seal, preventing flow past the valve head (125).

Figure 7:
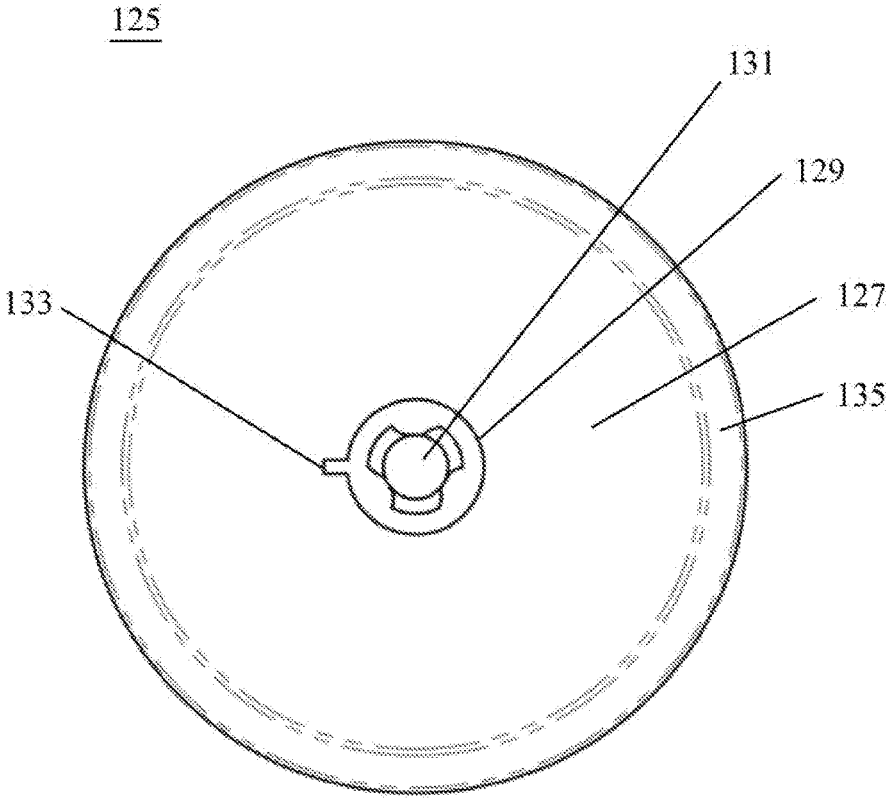
FIG. 7 is a two-dimensional top view of an exemplary disk-shaped plunger component of the closeable beverage lid made in accordance with the present teachings.

FIG. 7 is a two-dimensional top view of an exemplary disk-shaped valve (125) component of the closeable beverage lid made in accordance with the present teachings. Visible in this exemplary embodiment are the disk-shaped valve (125), with its flat upper surface (127) and chamfered valve face (135), as well as the vertical stem (129) with fastening aperture (131) and vertical flange (133).

Figure 8:
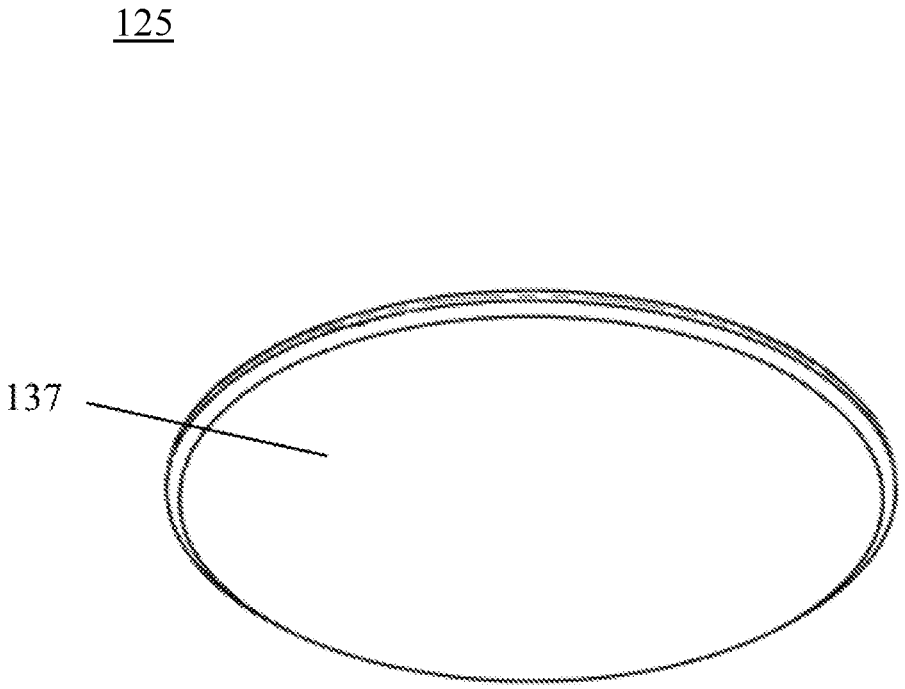
FIG. 8 is an isometric view of the disk-shaped plunger component of the closeable beverage lid illustrated in accordance with the present teachings.

FIG. 8 is an isometric bottom-view of the disk-shaped valve (125) component of the closeable beverage lid illustrated in accordance with the present teachings. Visible in this exemplary embodiment are the disk-shaped valve (125) with its substantially flat reverse surface (137) and chamfered valve face (135).

Figure 9:
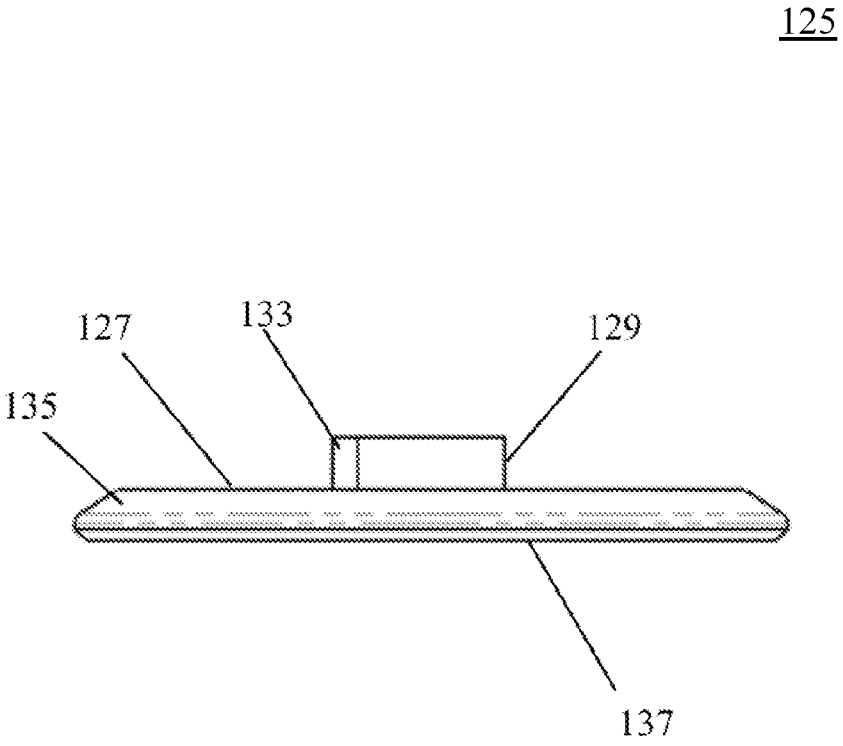
FIG. 9 is a two-dimensional profile view of the disk-shaped plunger component of the closeable beverage lid illustrated in accordance with the present teachings.

FIG. 9 is a two-dimensional profile view of the disk-shaped valve (125) component of the closeable beverage lid illustrated in accordance with the present teachings. Visible in this exemplary embodiment are the disk-shaped valve (125) with its substantially flat upper surface (127) and chamfered valve face (135), its substantially flat reverse surface (137), as well as the valve stem (129) and vertical flange (133).

In an alternative embodiment of the invention, the valve (125) is positioned above the base and seals against the upper surface of the base. An illustration of this alternative embodiment is provided in FIGS. 15 A and B of the attached drawings. As illustrated, the valve (125) is provided with a threaded stem (129) that is inserted into a correspondingly threaded recess (152) in the upper surface (112) of the base (101) illustrated in FIG. 13. Rotation of the valve (125) is achieved by the operator applying a force to the knob (139) that results in the downward linear motion of the valve (125) until the valve face (153) contacts the valve seat (163) sealing gasket (160) illustrated in FIG. 14.

E. Valve Actuating Means:

The valve actuating means may be any of a variety of mechanisms conventionally used in spill-resistant beverage containers (e.g. travel mugs) such as push-buttons, tabs, or knobs. See, e.g. Lane, M., U.S. Pat. No. 8,348,078 B2 issued Jan. 8, 2013; Chan, D. United States Patent Application Publication No. 2010/00200602 A1 published Aug. 12, 2010; or Lin, S-S. U.S. Pat. No. 6,659,302 B2 issued Dec. 9, 2003.

In the context of the invention as exemplified herein and described in the drawings, operation of the valve mechanism is achieved by the application of rotary force to the valve system. The application of rotary force may be facilitated through the use of a knob valve actuating means. The knob may be configured in any of a variety of shapes which facilitate grasping, particularly by the fingers of the operator. The surface of the knob may be configured in a variety of ways to facilitate grip by the operator such as through surface knurling, vertical ridges or through the application of non-slip coatings such as neoprene rubber.

Figure 10:
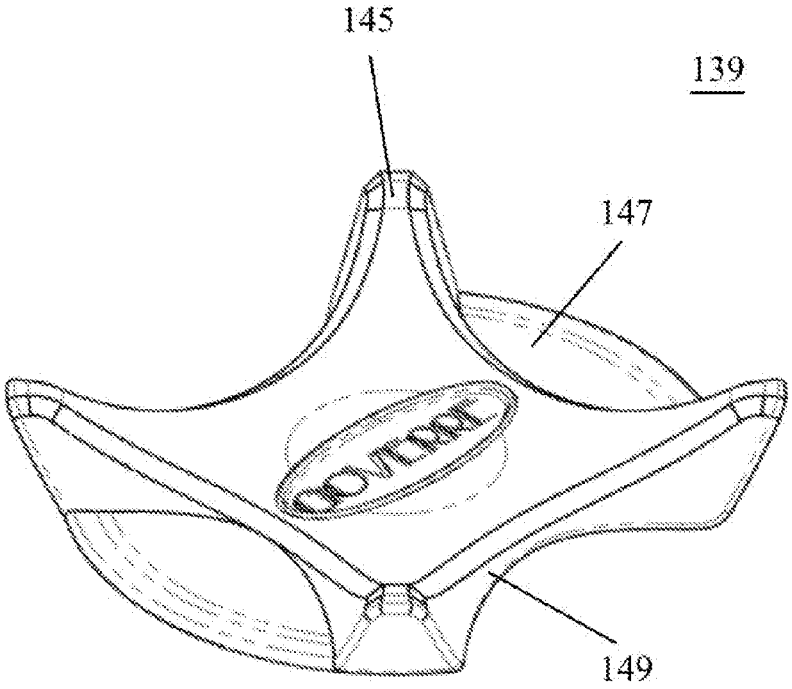
FIG. 10 is an isometric view of an exemplary illustration of the knob component of the closeable beverage lid illustrated in accordance with the present teachings.

FIG. 10 is an isometric view of an exemplary illustration of the knob (139) component of the closeable beverage lid illustrated in accordance with the present teachings. The foregoing exemplary embodiment generally comprises a circular shape with four legs (145) extending radially from the center of the knob and upwardly from the surface of the knob, to provide a grip position for a user's fingers to engage and rotate the knob. The exemplary embodiment of FIG. 10 employs a general circular shape upon which the legs (145) are positioned toward the perimeter of the circular knob (139) to provide maximum leverage and ease of use.

In one exemplary embodiment, illustrated in FIG. 10, the legs (145) define four circle segments, alternating between two arced cut-outs (149) and planar arced surfaces (147). When the knob is rotated to the "closed" position, the planar arced caps (147) cover the fluid apertures (111) in the base (101) of the lid to provide yet another method of preventing unwanted spillage. However, when the knob is rotated to the "open" position, the fluid apertures (111) in the base (101) are revealed by the arced cut-outs (149), which provide for the consumption of liquid, and simultaneous inflow of air to prevent turbulence or "glugging."

While the exemplary embodiment of FIG. 10 provides a generally circular knob (139) with four legs (145) and alternating cut-outs (149), those skilled in the art will appreciate that a knob may have fewer or additional legs. As long as the knob contains some feature to allow for a user to rotate said knob to engage a valve between the open and closed position, such a knob is intended to be within the scope of the present teachings. Additionally, while the knob (139) disclosed in the exemplary embodiment of FIG. 10 provides for alternating planar caps (147) and arced cut-outs (149), one skilled in the art will recognize that because the primary seal in the present disclosure is accomplished by the valve head (125) and the flanged gasket (117), said arced cut outs (149) and arced caps (147) are meant to provide redundancy, and the absence of said capping or revealing features are likewise intended to be within the scope of the present teachings.

Figure 11:
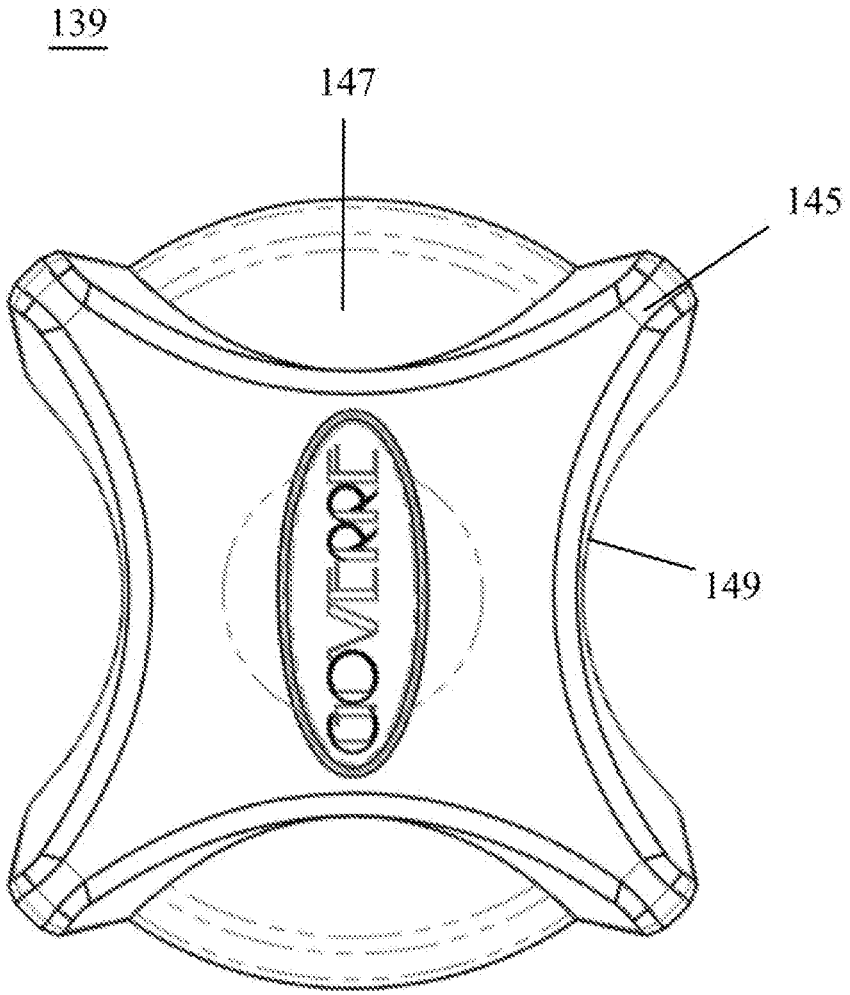
FIG. 11 is a two-dimensional top view of an exemplary illustration of the knob component of the closeable beverage lid made in accordance with the present teachings.

FIG. 11 is a two-dimensional top view of an exemplary illustration of the knob (139) component of the closeable beverage lid made in accordance with the present teachings. In view of the exemplary embodiment are the four legs (145) extending radially from the center of the knob and upwardly from the surface of the knob and the arced cut-outs (149), alternating with arced planar caps (147) in the circle segments created by the legs (145).

Figure 12:
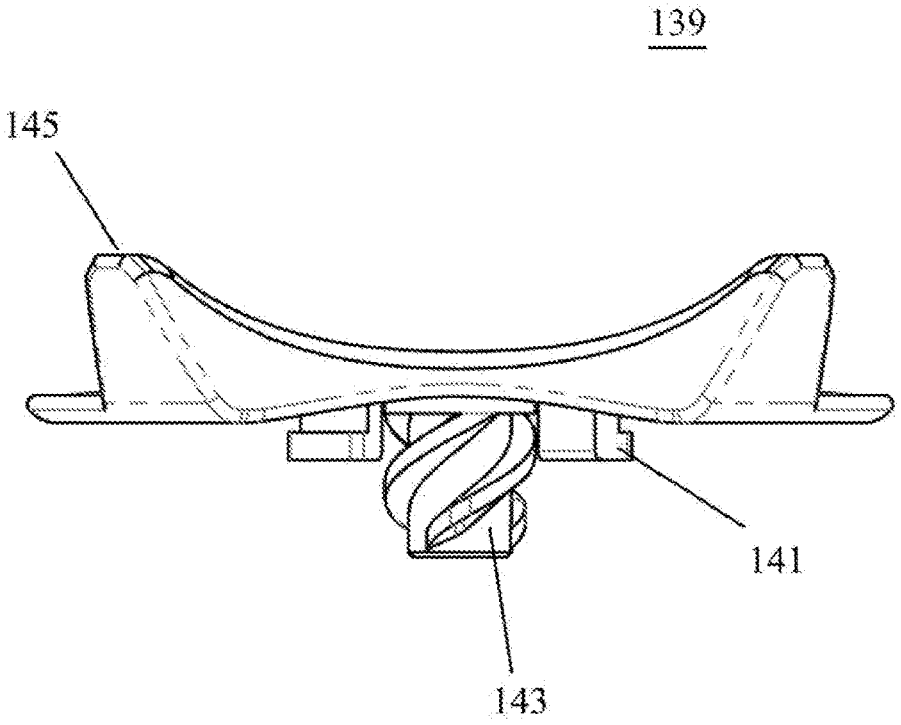
FIG. 12 is a two-dimensional profile view of an exemplary illustration of the knob component of the closeable beverage lid illustrated in accordance with the present teachings.

FIG. 12 is a two-dimensional profile view of an exemplary illustration of the knob (139) component of the closeable beverage lid illustrated in accordance with the present teachings. The foregoing exemplary embodiment comprises those features found in FIGS. 10 and 11 while further comprising a shaft (143) and a plurality of L-shaped flanges (141) extending downwardly from the bottom the knob (139). The exemplary embodiment of FIG. 12 reveals a shaft (143) threaded to engage with the internally-threaded fastening aperture (131) in the stem (129) of the valve (125) shown in FIGS. 6-9, but those skilled in the art will appreciate that alternative methods of fastening the knob (139) to the valve head (125) are intended to be within the scope of the present teachings. The L-shaped flanges (141)

are shaped and oriented to fit in the positive stop features (115) and thereby fasten the knob (139) to the base (101) of the lid.

Figure 15:
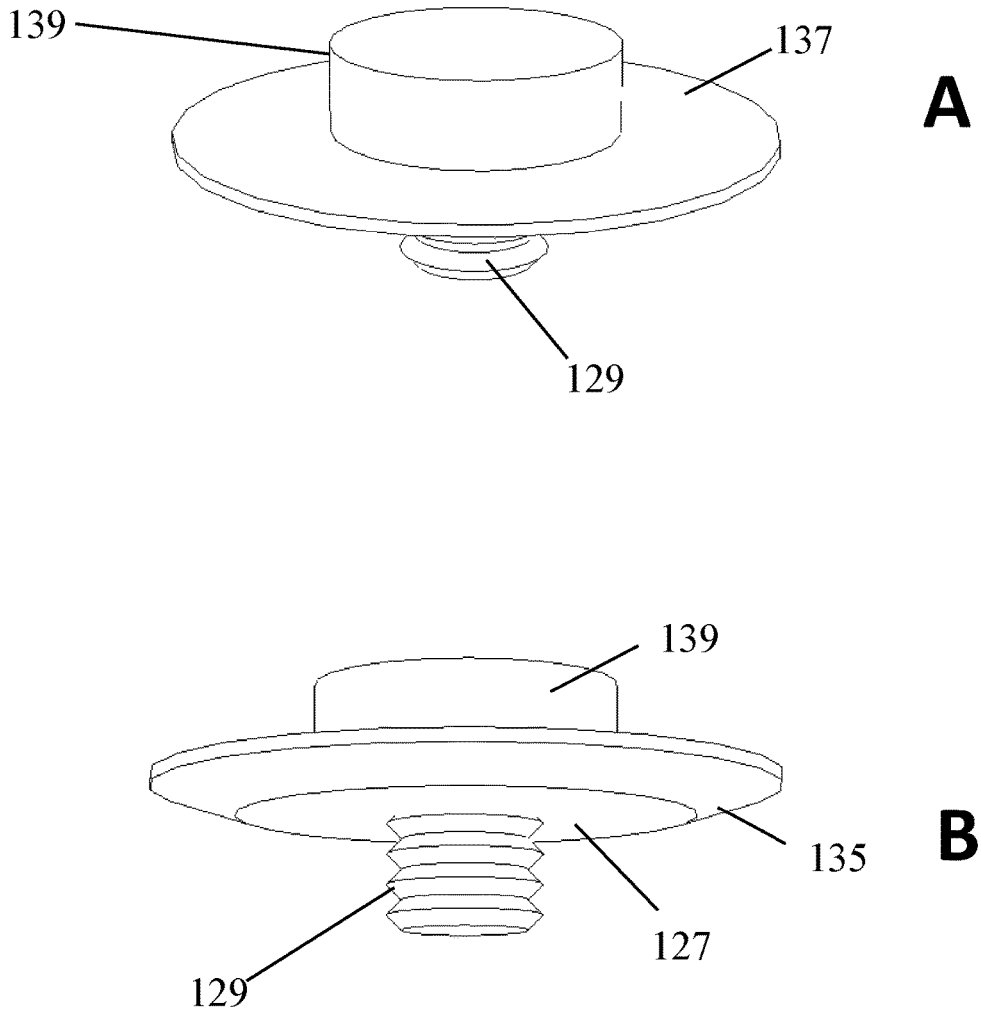
FIGS. 15 A and B are perspective views the upper surface of an integral knob and valve (Panel A) and the lower surface of an integrated knob and valve (Panel B) components of the closeable beverage lid illustrated in accordance with the present teachings.

In an alternative embodiment where the knob (139) is integrated into the substantially flat reverse surface of the valve (137). This alternative embodiment is illustrated in FIGS. 15 A and B of the attached drawings. As illustrated in FIGS. 15 A and B, the valve (125) and knob (139) are formed as a single integrated structure, the knob (139) being provided on the reverse surface of the valve (137). FIG. 15 B provides a lower view of the valve/knob assembly illustrating the lower surface of the valve (127) comprising a valve face (135) and threaded valve stem (129).

F. Lid Assembly

Figure 16:
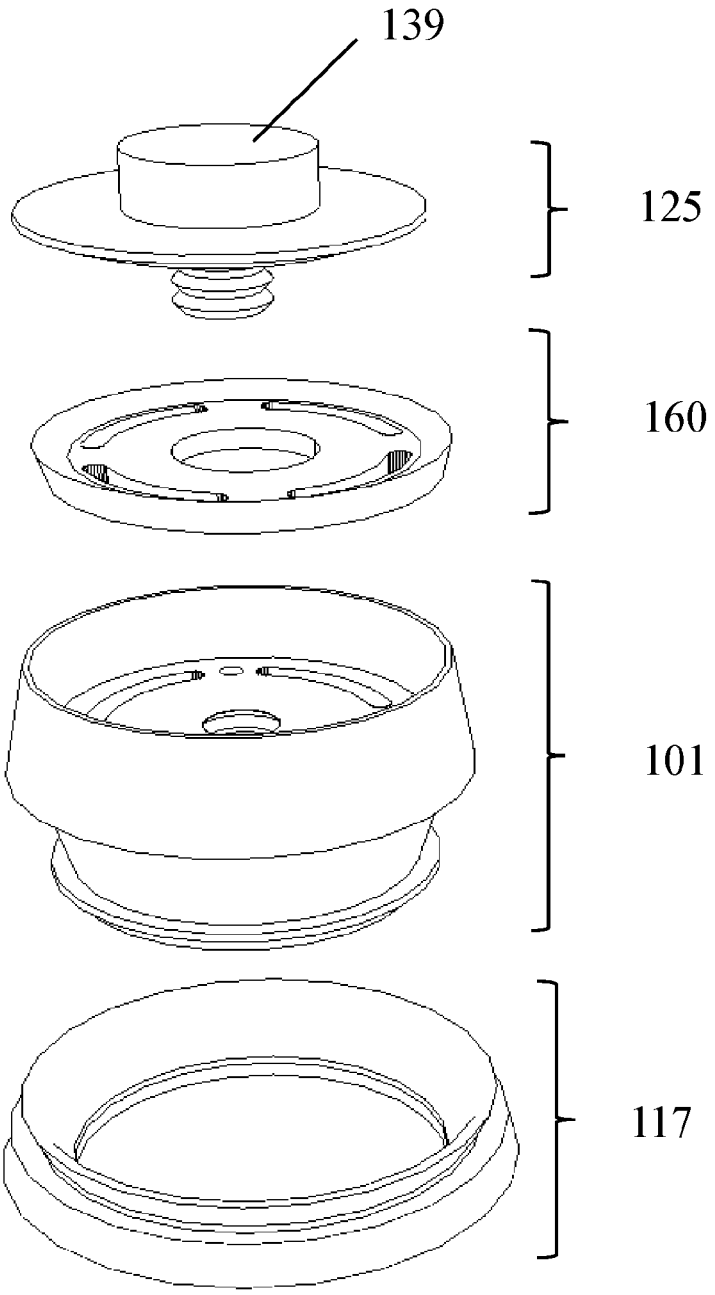
FIG. 16 is an exploded perspective view of a base, sealing gasket, valve and knob components of the closeable beverage lid illustrated in accordance with the present teachings.

The present invention further provides an assembly comprising a removable lid for a beverage container. An exploded view of one embodiment of the assembly of the present invention is provided in FIG. 16 a base (101) with fluid apertures (111), a sealing gasket (160) with fluid apertures (161), a valve (125), a knob (139), and a flanged gasket (117).

G. Lid and Beverage Container Assembly

The present invention further provides an assembly comprising a removable lid for a beverage container, a beverage container having a concave opening, and an energy absorbing coating. An exploded view of one embodiment of the assembly of the present invention is provided in FIG. 16 a base (101) with fluid apertures (111), a sealing gasket (160) with fluid apertures (161), a valve (125), a knob (139), a flanged gasket (117), a beverage container (170) fitted with an energy absorbing covering (180).

We claim:

1. A removable closeable lid adapted for use with a beverage container, said beverage container having a concave opening, said lid comprising:

a substantially rigid base, said base comprising at least one aperture to enable the contents of said beverage container to pass through said lid and a valve system to modulate the passage of fluids through said lid, said valve system comprising a valve and valve actuating means, said valve comprising an upper portion and a lower portion connected by a shaft, said upper portion of said valve comprising said valve actuating means and said lower portion of said valve comprising a disk shaped valve head having an upper face and lower face said upper face of said valve head providing a chamfered surface, said valve being vertically movable from a first open position to a second closed position in response to the operation of said valve actuating means, said base further providing an aperture to enable passage of said shaft through said lid and a chamfered valve seat configured to receive said disk shaped valve face of said valve, and a multi-flanged one-piece gasket, said gasket horizontally circumscribing said base and comprising at least two flanges said flanges including an upper flange and a lower flange said lower flange having a diameter greater than said upper flange and wherein the external diameter of said flanges are greater than the diameter of the opening of said beverage container and said flanges exert a radial force against the inside wall of said beverage container to provide a substantially fluid-tight pressure seal when said lid is fitted to said beverage container and said gasket provides stable association between said lid and the beverage container without additional fixation means.

2. The lid of claim 1, wherein said valve actuating means is a push button and said valve face is urged against said valve seat by a spring.

3. The lid of claim 1, wherein said valve actuating means is a knob and at least a portion of the surface of said shaft is threaded and the internal surface of said aperture in said base to receive said shaft provides a threaded surface configured to receive the threaded portion of said shaft.

4. The lid of claim 1, wherein the lower portion of said base provides an inner wall having an outer surface and said gasket provides an inner surface intact with said outer surface of said base, said outer surface of said base providing an annular ridge extending around the perimeter of said outer surface of said base and the inner surface of said gasket provides a groove configured to receive said annular ridge.

5. The lid of claim 1 wherein said multi-flanged one-piece gasket provides at least three flanges.

6. The lid of claim 1 wherein said lid provides an anti-microbial surface treatment.

7. An assembly comprising:

a removable lid adapted for use with a beverage container, said beverage container having a concave opening, said lid comprising a substantially rigid base, said base comprising at least one aperture to enable the contents of said beverage container to pass through said lid and a valve system to modulate the passage of fluids through said lid, said valve system comprising a valve, said valve comprising an upper portion and a lower portion connected by a shaft, said upper portion of said valve comprising said valve actuating means and said lower portion of said valve comprising a disk shaped valve head having an upper face and lower face said upper face of said valve head providing a chamfered surface, said valve being vertically movable from a first open position to a second closed position in response to the operation of said valve actuating means, said base further said base further providing an aperture to enable passage of said shaft through said lid and a chamfered valve seat configured to receive said disk shaped valve face of said valve;

a multi-flanged one-piece gasket, said gasket horizontally circumscribing said base and comprising at least two flanges said flanges including an upper flange and a lower flange said lower flange having a diameter greater than said upper flange and wherein the external diameter of said flanges are greater than the diameter of the opening of said beverage container and said flanges exert a radial force against the inside wall of said beverage container to provide a substantially fluid-tight pressure seal when said lid is fitted to said beverage container and said gasket provides stable association between said lid and the beverage container without additional fixation means; and a beverage container having a concave opening.

8. The assembly of claim 7, wherein the lower portion of said base provides an inner wall having an outer surface and said gasket provides an inner surface intact with said outer surface of said base, said outer surface of said base providing an annular ridge extending around the perimeter of said outer surface of said base and the inner surface of said gasket provides a groove configured to receive said annular ridge.

9. The assembly of claim 7 further wherein the beverage container is provided with an energy absorbing covering.

10. The assembly of claim 9 wherein said energy absorbing covering is removable.

11. The assembly of claim 10 wherein said energy absorbing covering is constructed of materials selected from the group consisting of rubber, silicone rubber, open cell foam, closed cell foam, neoprene, and fabric.

12. The assembly of claim 7 wherein the beverage container is a stemless wine glass.

13. The assembly of claim 9 wherein the beverage container is a stemless wine glass.

14. A removable lid for a beverage container, said beverage container having a concave opening, said lid comprising a substantially rigid base circumscribed by a multi-flanged one-piece gasket, said gasket horizontally circumscribing said base and comprising at least two flanges said flanges including an upper flange and a lower flange said lower flange having a diameter greater than said upper flange and wherein the external diameter of said flanges are greater than the diameter of the opening of said beverage container and said flanges exert a radial force against the inside wall of said beverage container to provide a substantially fluid-tight pressure seal when said lid is fitted to said beverage container and said gasket provides stable association between said lid and the beverage container without additional fixation means wherein the lower portion of said base provides an inner wall having an outer surface and said gasket provides an inner surface intact with said outer surface of said base, said outer surface of said base providing an annular ridge extending around the perimeter of said outer surface of said base and the inner surface of said gasket provides a groove configured to receive said annular ridge.

15. The lid of claim 14 wherein said lid provides an anti-microbial surface treatment.

* * * * *